United States Patent [19]

O'Connor

[11] 3,987,775

[45] Oct. 26, 1976

[54] SQUEEZE-TUBE PRIMER FOR INTERNAL COMBUSTION ENGINES

[75] Inventor: Alton J. O'Connor, Cass City, Mich.

[73] Assignee: Walbro Corporation, Cass City, Mich.

[22] Filed: Apr. 16, 1975

[21] Appl. No.: 568,626

[52] U.S. Cl. ..... 123/187.5 R; 123/139 A; 123/DIG. 5; 417/394; 417/478

[51] Int. Cl.[2] ..... F02M 1/16

[58] Field of Search.. 123/139 A, 139 AA, 139 AH, 123/187.5 R, DIG. 5; 417/383, 394, 478

[56] References Cited

UNITED STATES PATENTS

| | | | |
|---|---|---|---|
| 2,984,188 | 5/1961 | Tuckey et al. | 417/394 |
| 3,007,416 | 11/1961 | Childs | 417/394 |
| 3,037,497 | 6/1962 | Roberson | 417/394 |
| 3,158,104 | 11/1964 | Hutchinson | 417/478 |
| 3,371,658 | 3/1968 | Turner | 123/187.5 R |
| 3,604,016 | 9/1971 | Robinson | 417/394 |

*Primary Examiner*—Wendell E. Burns
*Assistant Examiner*—David D. Reynolds
*Attorney, Agent, or Firm*—Barnes, Kisselle, Raisch & Choate

[57] ABSTRACT

A combination primer and pump for internal combustion engines which utilizes a flexible cylindrical housing having a flexing liner with unidirectional valves at each end. The walls of the cylinder permit manual flexing or squeezing to pump fuel and a pulse connection in the outer housing connects the crankcase pulse of an engine being supplied with fuel to the inner, more flexible, liner to permit pumping action to take place when the engine is running. A pressure pulse passage between the outer and inner liner is positioned to be closed when the device is manually squeezed to achieve the priming function.

5 Claims, 3 Drawing Figures

SQUEEZE-TUBE PRIMER FOR INTERNAL COMBUSTION ENGINES

This invention relates to a Squeeze-Tube Primer for Internal Combustion Engines. More particularly, the invention is directed to a single unit which can serve not only as a manual primer for small engines such as those used on lawn mowers, snowmobiles and other similar applications, but also has a pulse pump which will serve as a fuel pump for the engine in normal operation after starting.

Reference is made to my copending application, Ser. No. 553,085, filed Feb. 26, 1975, directed to a related type of primer and pump construction.

It is an object of the present invention to provide a relatively simple and inexpensive pumping element which can serve the double function and which yet will be inexpensive to manufacture and serviceable over long periods of time.

It is a further object of the invention to provide a primer construction in which a single opening between the inner and outer primer elements serves to conduct an engine pulse to cause a pumping action while a manual closing pressure on a central area of the primer will cut off this opening to permit a manual primer function to be accomplished.

Other objects and features of the invention will be apparent in the following description and claims in which the principles of the invention are set forth, together with the best mode presently contemplated for the practice of the invention.

Figure 1:
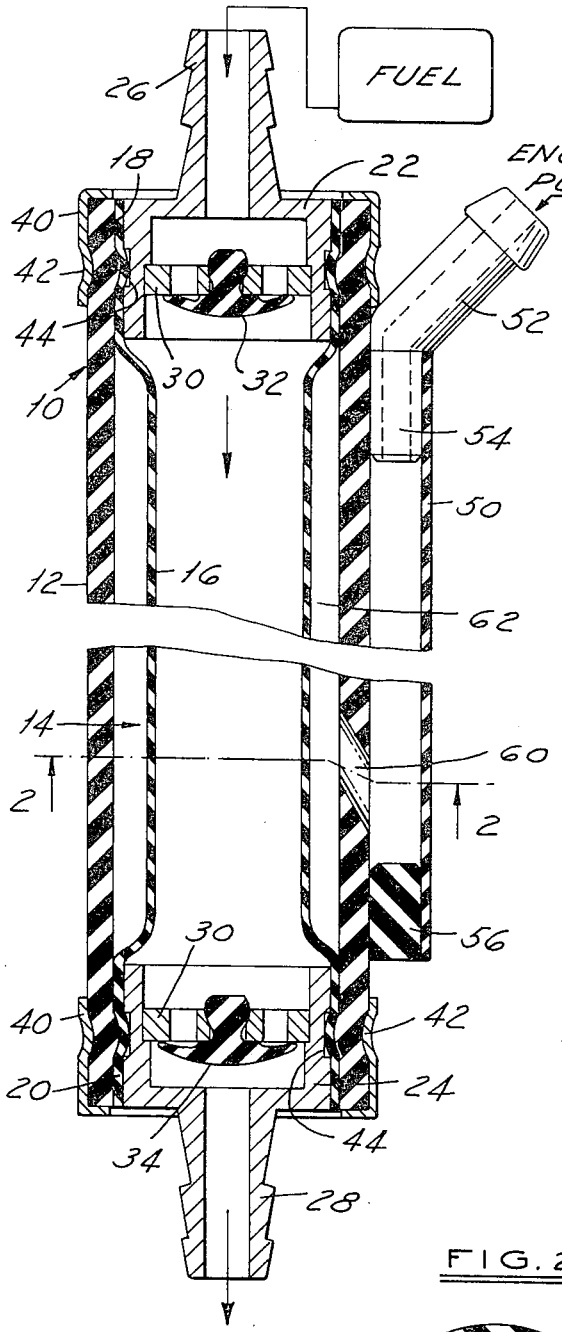

Drawings accompany the disclosure and the various views thereof may be briefly described as:

FIG. 1, a sectional view of the primer and pump unit.

Figure 2:
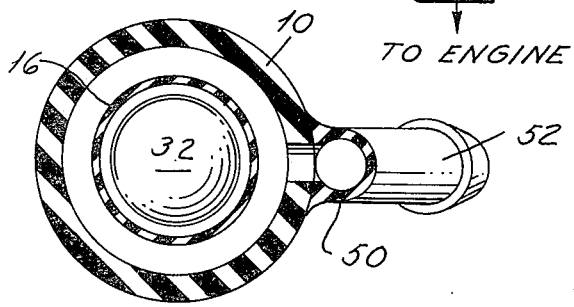

FIG. 2, a sectional view on line 2—2 of FIG. 1.

Figure 3:
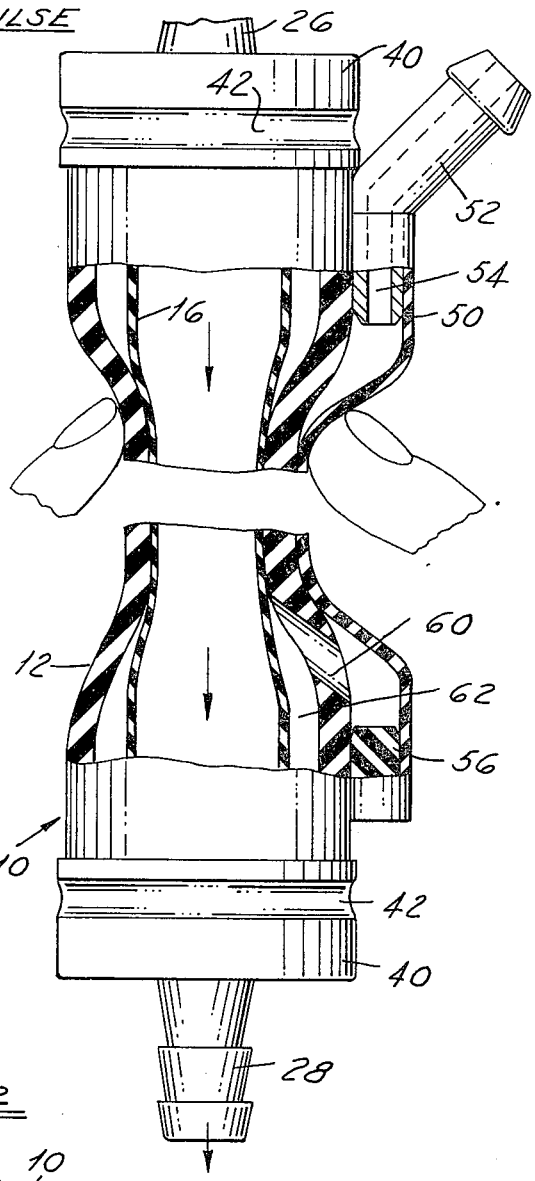

FIG. 3, a view partially in section showing the manner in which the device is manually operated.

REFERRING TO THE DRAWINGS

The combination primer and pump unit is shown generally at 10 having an outer flexible housing wall 12, cylindrical in shape and open at each end. The wall 12 is formed of a flexible material such as neoprene or other similar material which is resistant to hydrocarbons and which can be easily flexed with the fingers. The thickness of this wall in the embodiment shown can be 3 to 4 millimeters, the length around 7 ½ centimeters, and the diameter about 2 ½ centimeters.

Within the cylinder 12 is a liner member 14, also open at the ends, having a restricted portion 16 along most of its length, the ends 18 and 20 being enlarged to have an outer diameter similar to that of the inside diameter of the element 12. This element 14 can be formed of a rather thin pliant material also resistant to hydrocarbons. There are identical end pieces 22 and 24 at each end of the construction, each end piece having a cylindrical portion within the ends of the members 12 and 14 and each member having a projecting nipple portion 26 and 28, respectively, for the connection of fuel conduits in the form of flexible tubes. Each end piece 22 and 24 has a pressed-in, perforated disc 30 carrying, respectively, valves 32 and 34.

Valve 32 allows flow into the interior of member 16 and valve 34 allows flow outwardly. The assembly is retained at each end by a malleable or plastic retaining collar 40 opened at the ends and compressed inwardly to form a groove 42. An annular groove 44 on the outer surface of the end pieces 22 and 24 allows the portion of the inner member 16 to be pressed inwardly to effect a locking or gripping action when the retaining collars are also pressed in. Thus, the members 12 and 14 are securely fastened to the end pieces.

On one side of the element 12 is an axially extending tube 50 opened at its inner side to the exterior of the member 12. At one end of the tube, an engine pulse connector fixture 52 is inserted at 54 to close the end of the tube 50 and to provide a connection for an engine pulse tube. The other end of the tube 50 is closed by a plug 56.

It will be noted that there is an angled hole 60 leading from the interior of the tube 50 to the chamber 62 which is formed between the ensmalled portion 16 of the tube 14 and the member 12. This hole 60 allows pulse from the engine fixture 52 to reach the inner flexing member 16 so that it may expand and contract to provide a pumping action which will move fuel through the pump from a fuel supply to an engine (not shown). Thus, when the engine is operating the device will serve as a fuel pump in a normal fashion.

In some cases, in starting an engine, it is desirable to have a priming action prior to the cranking action. With the present device, this can be accomplished by applying the thumb and forefinger to the mid-section of the device as illustrated particularly in FIG. 3, the thumb being applied to the tube 50 so that it squeezes shut the tube 50 against the wall of the member 12. This action closes the opening 60 from the fixture 52 so that the repetitive squeezing of the outer unit tube 12 will cause a pumping action to initiate flow of fuel from a fuel supply tank to an engine.

The outer wall 12 has sufficient strength that it will resist significant change of dimension due to the engine pulse, thus permitting the inner flexing element 60 to enlarge and contract to create the pumping action. Nevertheless, the wall 12 is such that it can be readily squeezed by hand to accomplish the priming action above described.

I claim:

1. A combination primer and pump which comprises:

a. a pair of unsheathed, elongate concentric pliant tubes, the outer tube having a stiffer wall than the inner tube, b. a closure at each end of said tubes having passages serving as inlet and outlet, respectively, to be connected to a fuel supply and an engine, c. a unidirectional valve in each of said closures, and d. means forming a passage associated with said outer tube to conduct a pulse pressure from an engine to a space between said tubes to cause said inner tubes to deflate and inflate sequentially to serve as a pump, said passage means and said tubes being collapsible by the application of manual pressure for the purpose of manually pulsing said tubes to utilize said tubes as a manual primer pump in the absence of said pulse pressure.

2. A combination primer and pump which comprises:

a. a pair of unsheathed, elongate concentric pliant tubes dimensioned to form a chamber between the outer wall of the inner tube and the inner wall of the outer tube, said outer tube having a stiffer wall than the inner tube, b. means forming inlet and outlet valves for the chamber within the inner tube, and c. means forming a passage on the wall of the outer tube leading to the space between the tubes for the connection of a pulse source to cause said inner tube to deflate and inflate sequentially to operate as a pulse pump, said passage means and said tubes being collapsible by the application of manual pressure for the purpose of closing said passage and compressing said tubes to utilize said tubes as a manual primer pump in the absence of said pulse pressure.

3. A combination primer and pump which comprises:

a. a pair of unsheathed, elongate concentric pliant tubes dimensioned to form a chamber between the outer wall of the inner tube and the inner wall of the outer tube, said outer tube having a stiffer wall than the inner tube, b. means forming inlet and outlet valves for the chamber within the inner tube, and c. means comprising a pulse tube mounted on said outer tube having a diameter materially smaller than said outer tube and having one end pneumatically connected to said chamber and the other connectible to a source of pulse pressure to cause said inner tube to deflate and inflate sequentially to operate as a pulse pump, said passage means and said tubes being collapsible by the application of manual pressure for the purpose of closing said pulse tube and compressing said tubes to utilize said concentric tubes as a manual primer pump.

4. A pulse pump construction comprising:

a. an outer cylindrical tube, b. a closure at each end of said tube comprising a cup-like plug fitted into the respective ends of the tube each having in the cup bottom an outwardly extending nipple connection and having an annular groove in the outer wall of the cup, c. a perforate disc carried within the walls of each cup in a plane transverse to the axis of the cup, d. a unidirectional valve mounted on each said disc, e. an inner pliant tube within the outer tube having its ends trapped between the walls of said outer housing and the outer walls of said cups, f. means at the ends of said outer housing crimped inwardly to lock said inner tube and said outer tube into said respective grooves on said closures to retain the parts in assembly, and g. means forming an engine pulse passage into the space between said tubes to cause sequential inflation and deflation of the inner tube to effect a pumping action through said valves and inner tube.

5. A pulse pump construction as defined in claim 4 in which said means at the ends of said outer housing comprises a cap with an aperture to receive and surround said outwardly extending nipples, the walls of said cap enclosing and extending over the ends of said tubes and axially a predetermined distance from the ends of said tubes to overlie said tubes.

* * * * *